United States Patent [19]

Suzuki et al.

[11] Patent Number: 4,740,817

[45] Date of Patent: Apr. 26, 1988

[54] PICTURE RECORDING APPARATUS

[75] Inventors: Mitsuo Suzuki; Seiji Yonekura, both of Hitachi; Masayoshi Furuichi, Tokyo, all of Japan

[73] Assignee: Hitachi, Ltd., Tokyo, Japan

[21] Appl. No.: 851,827

[22] Filed: Apr. 14, 1986

[30] Foreign Application Priority Data

Apr. 12, 1985 [JP] Japan ..... 60-76499

[51] Int. Cl.[4] ..... G03G 15/00; B65H 1/22

[52] U.S. Cl. ..... 355/14 SH; 355/3 SH; 355/3 R; 271/3; 271/127; 271/164; 271/186

[58] Field of Search ..... 355/3 R, 3 SH, 14 SH; 271/3, 127, 164, 186, 291, 902

[56] References Cited

U.S. PATENT DOCUMENTS

| | | | |
|---|---|---|---|
| 3,544,101 | 12/1970 | Kolibas | 271/285 |
| 4,147,426 | 4/1979 | Miyoshi et al. | 355/3 DR X |
| 4,234,250 | 11/1980 | Mailloux et al. | 355/3 R X |
| 4,385,825 | 5/1983 | Kaneko | 355/3 SH |
| 4,523,832 | 6/1985 | Strutt et al. | 355/3 SH |
| 4,593,993 | 6/1986 | Imaizumi | 271/306 |
| 4,609,281 | 9/1986 | Miyai et al. | 335/3 R |

FOREIGN PATENT DOCUMENTS

| | | | |
|---|---|---|---|
| 58-147758 | 9/1983 | Japan | 355/14 SH |
| 59-41361 | 3/1984 | Japan . | |
| 59-214040 | 12/1984 | Japan | 355/3 SH |

*Primary Examiner*—Arthur T. Grimley
*Assistant Examiner*—Jane K. Lau
*Attorney, Agent, or Firm*—Antonelli, Terry & Wands

[57] ABSTRACT

A picture recording apparatus laser beam printer wherein a cassette, accommodating paper for receiving a transferred image, is loaded or unloaded on a front side of a housing of the printer. The conveyance direction of the paper accommodated in the cassette is reversed so as to be supplied to a transfer section by a paper separation reversal guide section. The conveyance direction of the paper is further reversed so as to be discharged on a tray in manner such that a forward end of the paper is located on a front surface side and an image transfer surface of the paper is faced downwardly. A manual paper feeding section is provided on the front side of the housing. A major portion of the cassette can be accommodated inside the housing whereby and the installation area can be reduced.

4 Claims, 2 Drawing Sheets

PICTURE RECORDING APPARATUS

BACKGROUND OF THE INVENTION

The present invention relates to an image recording apparatus for forming image information on a cut paper and, more particularly, to a picture recording apparatus which is suitable for a laser beam printer employing an electrophotographic system.

In Japanese Utility Model Laid-open No. 59-41361, a conventional picture recording apparatus is proposed wherein a cassette, accommodating cut paper, is inserted into a body of the apparatus from a side direction and is loaded or unloaded therefrom. A major portion of the cassette is not accommodated in the device body and projects from the body of the apparatus, with the cut paper in the cassette being removed by a pick-up roller.

The picture information, formed on a photosensitive drum is transferred on the cut paper by a transfer means, and is fixed on the cut paper by fixing rollers. The cut paper is reversed back by a paper reversing guide and, after that, the cut paper discharged by discharge rollers on a tray provided on the upper surface side of the body of the apparatus. At this time, the surface of the cut paper on which the information is printed faces downwardly and the following pages are sequentially discharged on the former cut paper.

The above-described image recording apparatus is advantageous in that it is unnecessary to accomplish the replacement of the cut pages later. However, a disadvantage resides in the fact that it has an overall length of the image recording apparatus is a sum of the length of the body of the apparatus and the length of the outwardly projected part of the cassette, and thus is made larger.

Further, since the cassette projects outwardly from the body of the apparatus, there is a danger that a person may strike the outwardly projected portion of the cassette. This kind of the picture recording apparatus provides no paper feeding section for manually feeding paper therewith.

Another prior art apparatus of the aforementioned type accommodates a major portion of a cassette in a body of the apparatus. The cassette is inserted into or is removed from body from the side direction. The cut paper accommodated in the cassette is removed by a pick-up roller and is then reversed so as to come into contact with a photosensitive drum.

The picture information on the photosensitive drum is transferred to the cut paper by a transfer means and is then fixed thereon by fixing rollers. After that, the cut paper is discharged on a tray by discharge rollers. A major portion of the tray projects outwardly from the body. This picture recording apparatus provides a paper feeding section for manually feeding paper on the side opposite the insertion side of the cassette.

A disadvantage of this picture recording apparatus resides in the fact than an overall length of the picture recording apparatus is a sum of the length of the body of the apparatus and the length of the outwardly projected portion of the tray, and, consequently, the apparatus is relatively large.

Moreover, upon using other type of paper than the paper accommodated in the cassette, the feeding of the paper through the manually paper feeding section is carried out by hand, but a guide plate of the manually paper feeding section for the manually-inserted paper is disadvantageous in that the guide plate for the manually paper feeding section, is located on a side opposite to an insertion side of the cassette due to the constructional design of the paper conveyance system.

An object of the present invention resides in providing a picture recording apparatus requiring only a small installation area.

Another object of the present invention resides in providing a image recording apparatus containing no projections extending outwardly from a body of the apparatus.

In accordance with the present invention paper removed from a cassette, inserted into a body is reversed so as to send the paper to a transfer section and further reversed so as to be discharged to an upper surface side of the body of the apparatus.

Thus, the present invention functions to reduce a projected part of the cassette by inserting a major portion of the cassette into the body of the apparatus and reduces a projected portion of a tray for receiving discharged paper by discharging the paper to an upper surface side of the body of the apparatus.

In accordance with the present invention, a laser beam printer for producing picture information by transferring a toner image on paper includes a body or housing for receiving a sheet accommodating a cassette inserted into a bottom portion of the body. A pick-up roller removes the paper in the cassette, a photosensitive drum forms the toner image disposed in the body of the apparatus. A laser beam exposes the photosensitive drum and a transfer means transfers the toner image formed on the photosensitive drum to the paper. A developing apparatus forms the toner image on the photosensitive drum and resist rollers causing the paper to be conveyed in synchronism with the circumferential speed of the photosensitive drum so as to come into contact with the photosensitive drum. A means fixes the toner image on the paper, and a paper reversing guide reverses the paper from the fixing means. Discharge rollers discharge the paper with a transferred surface facing downwardly, and a tray is provided on an upper surface of the body the apparatus for receiving the paper from the discharge rollers.

In accordance with the present invention, the cut paper in the laser beam printer is reversed to the transfer means and is removed from a rear side in a direction of inserting the cassette.

According to the present invention, the major portion of the cassette can be accommodated inside the body of the apparatus and the installation area can be reduced because the paper is discharged on the upper surface side of the body.

Further, since the present invention reduces projecting portions, it is possible to increases the safety the image recording apparatus.

DETAILED DESCRIPTION

Figure 1:
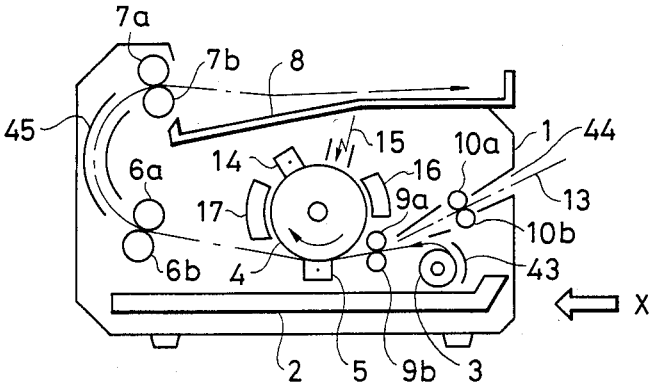
FIG. 1 is a schematic side view of a laser beam printer of one embodiment of the present invention.

Referring now to the drawings wherein like reference numerals are used throughout the various views to designate like parts and, more particularly, to FIG. 1, according to this figure, for image or picture formation in a laser beam printer electrophotographic system, a photosensitive drum 4 is rotated in the direction of the arrow and a corona discharger 14 for charging, a laser beam 15 to be radiated for exposuring, a developing apparatus 16, a corona discharger 14 for transferring and a cleaner 17 are disposed around the photosensitive drum 4.

A cassette 2 accommodating sheets of cut paper 21 (see FIGS. 2–5) is inserted into a bottom portion of a body or housing 1 from the front side of the housing 1 in the direction of the arrow X and an entire portion of the cassette 2 is allowed to be accommodated inside the body 1. A pick-up roller 3 allows the cut paper 21 to be removed from the cassette 2 on the rear end side in the direction of insertion of the cassette 2 and a paper reversing guide 43 serves to reverse the cut paper 21 back so as to convey the paper 21 to resist rollers *9a, 9b*.

Next, the cut paper 21 comes into contact with the photosensitive drum 4 so that the picture information (toner image) formed on the photosensitive drum 4 may be transferred to the cut paper 21 by a transfer means 5. After that, the cut paper 21 passes through a path shown by a one-dot chain line and fixing means *6a, 6b* serve to fix the picture information on the cut paper 21.

Further, the cut paper 21 is reversed by another paper reversing guide 45 provided on rear end portion of the body 1 and then is discharged by discharge roller *7a, 7b* to a tray 8 provided on the upper surface side of the body 1 with the transferred surface facing downwardly.

To manually feed or manually insert a paper 13, the paper 13 is inserted into a paper feeding section 44 provided on the same side (front side) as that of the insertion of the cassette 2 as shown by a one-dot chain line and is then conveyed to the resist rollers *9a,* and *9b* by conveyance rollers *10a, 10b*. After that, the same process as in the case of feeding the cut paper 21 from the cassette 2 is followed.

Figure 2:
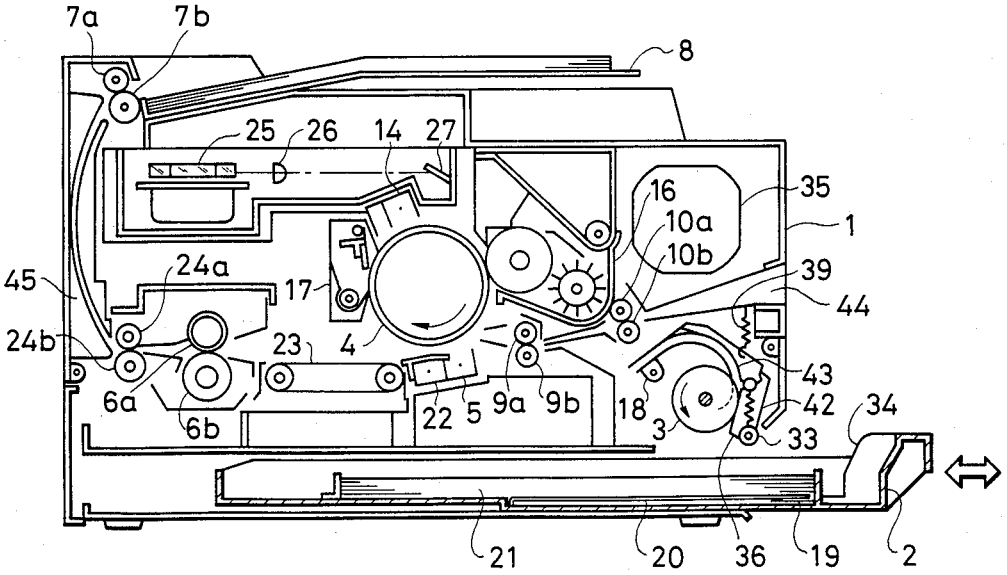
FIGS. 2 and 3 are detailed sectional views of the laser beam printer of FIG. 1.

As shown in FIG. 2, the photosensitive drum 4 disposed in the device body 1 is driven to rotate in the direction. of the arrow, with the corona discharger 14 serving to uniformly charge the photosensitive drum 4 and the laser beam 15 radiates the photosensitive drum 4 by a laser optical unit including a laser diode (not shown), a polygon mirror 25, a lens 26, a mirror 27 and the like. A cooling fan 35 is disposed in the body 1.

Next, a developing apparatus 16 serves to form the toner image on the photosensitive drum 4. A pick-up roller 3, rotatable in the direction of the arrow, removes the cut paper 21 from the cassette 2. A separation belt 36, of a polyurethane foam sheet, is supported by a supporting body 42 and is integrated with the first paper reversing guide 43.

This section is referred to as a paper separation reversal guide section. The paper separation reversal guide section is rotatably supported on a through shaft 18. When the cassette 2 is not loaded in the body 1, the paper separation reversal guide section is retained at the position shown in FIG. 2 by a spring 39.

When the cassette 2 is set in the body 1 as a result of the sliding movement in the direction of the arrow X, an operation plate 34 provided in the cassette 2 contacts a roller 33 of the paper separation reversal guide section. The inserting force of the cassette 2 from the front side permits a rotative movement of the paper separation reversal guide section around the through shaft 18.

Figure 3:
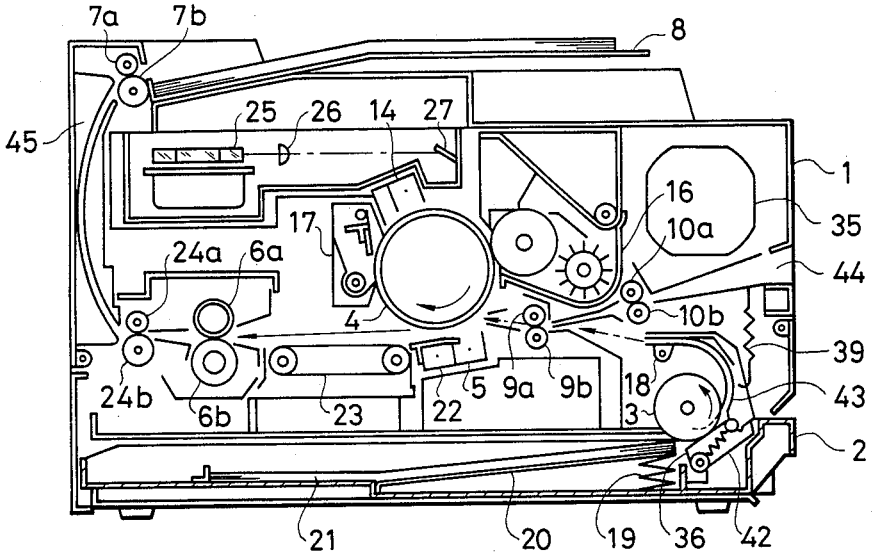

When the cassette 2 is set in the body 1, the roller 33 of the paper separation reversal guide section is pushed by the operation plate 34 provided in the cassette 2 and to the position shown in FIG. 3. The cut paper 21 in the cassette 2 is removed from the rear end side by rotation of the pick-up roller 3 and then contacts the separation belt 36.

At this time, when at least two sheets of cut paper 21 are removed by the pick-up roller 3, by suitably selecting coefficients of friction between the pick-up roller 3 and the cut paper 21, between each sheet of the cut paper 21, and between the cut paper 21 and the separation belt 36, the cut paper 21 can be separated in the paper separation reversal guide section and thus only one sheet of cut paper 21 is conveyed to pass through the first paper reversing guide 43 by means of the pick-up roller 3.

The cut paper 21 reaches the resist rollers *9a, 9b* while it is reversed and guided. The rotation drive of the resist rollers *9a, 9b* causes the cut paper 21 to be conveyed in synchronism with the circumferential speed of the photosensitive drum 4 so as to contact the photosensitive drum 4, where the cut paper 21 is given the transfer of a toner image by the transfer means 5 and has charges removed by a charge-remover 22.

Then, the cut paper 21 is separated from the photosensitive drum 4 and is conveyed by a conveyance belt 23 and then is heated and fixed by the fixing rollers *6a, 6b*. Lastly, the cut paper 21 is discharged onto the tray 8 provided on the upper surface side of the body 1 as the picture-transferred surface faces downwardly by the discharge rollers *24a* and *24b*, the discharge rollers *7a* and *7b*, the second paper reversing guide 45.

Figure 4:
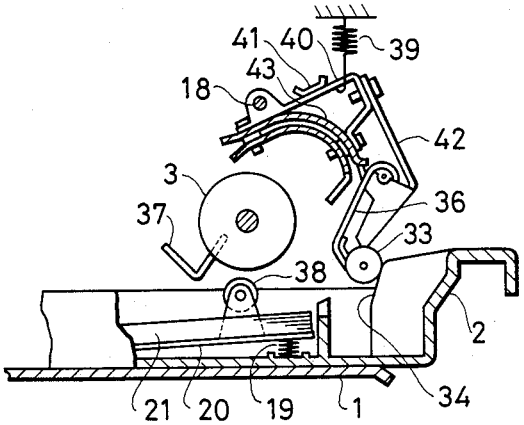
FIGS. 4 and 5 are partial enlarged detail views of a cassette and paper separation and reversal guide of the laser beam printer of FIG. 1.

FIG. 4 shows a state in which the cassette 2 is not inserted into the positive position of the body 1, and, this state, the paper separation reversal guide section is rotatably supported by the shaft 18.

The paper separation reversal guide section comprises the separation belt 36, the supporting body 42 for supporting the separation belt 36, an arm 40, the first paper reversing guide 43 and the roller 33 rotatably supported at the tip of the supporting body 42. The paper separation reversal guide section is pulled upwardly by means of the spring 39 and is stopped by a stopper 41.

Further, at this time, the cut paper 21 in the cassette 2 stays in the low position because a plate 20 is held in the position shown in FIG. 4 by a locking mechanism (not shown). Further insertion of the cassette 2 from the front side allows the operation plate 34, provided in the cassette 2, to contact the roller 33 and to move downwardly against the spring force of the spring 39.

Figure 5:
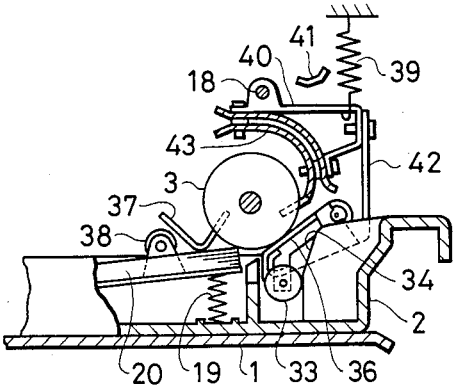

Consequently, the state shown in FIG. 5 is brought about and, at this time, the locking mechanism for the plate 20 provided in the cassette 2, serves to release its locking by a projection (not shown) provided in the body 1.

The plate 20 is pushed upwardly by the spring force of the cassette spring 19 and the cut paper 21 on the plate 20 comes into contact with the pick-up roller 3, whereby the cut paper 21 can be removed.

In the case of unloading the cassette 2 from the body 1, a guide member 37, provided in the device body 1, serves to push down the rollers 38 provided on both sides of the plate 20. Thus, the rollers 38 are held in the lowest position by the locking mechanism so as to prevent the cut paper 21 from getting in the way upon a pulling or extracting of the cassette 2 out of the body 1.

What is claimed is:

1. An image recording apparatus for producing image information by transferring a toner image on paper, the apparatus comprising a housing means; a cassette means for accommodating sheets of paper, said cassette means being insertable into a bottom portion of said housing means and being adapted to be loaded and unloaded from a front side of said housing means; pickup roller means for removing the paper from said cassette means; a photosensitive drum means disposed in said housing means for forming a toner image; a radiating laser beam means for exposure to said photosensitive drum; a transfer means for transferring the toner image formed on said photosensitive drum to the paper; a developing means for forming the toner image on said photosensitive drum means; resist roller means for causing the paper to be conveyed in synchronism with a circumferential speed of said photosensitive drum means so as to come into contact with said photosensitive drum means; fixing means for fixing the toner image on the paper; a paper reversing guide means for reversing a conveying direction of the paper from said fixing means; discharge roller means for discharging the paper with the image transfer surface facing downwardly; tray means provided on an upper surface of said housing means for receiving the paper from said discharge roller means; paper separation and guide means for removing the paper from the cassette means in a direction opposite to an insertion direction of said cassette means and guiding the paper so as to feed the paper to said transfer means, said paper separation and guide means being arranged in said housing means so as to remove the paper from a rear side of said cassette means as viewed in the insertion direction of said cassette means into the housing means, wherein said paper separation and guide means comprises a separation belt, a supporting body for supporting said separation belt, an arm means, a paper reversing guide, and a roller means rotatably supported at a tip of said supporting body.

2. A recording apparatus according to claim 1, further comprising a manual paper feed means provided on a front side of the housing means for enabling a feeding of a paper including conveyance roller means for conveying the manually inserted paper to said resist roller means.

3. An image recording apparatus according to claim 1, further comprising a shaft means for rotatably supporting said paper separation and guide means, spring means for pulling said separation and guide means upwardly when said cassette means is not inserted into a positive position of said housing means.

4. An image recording apparatus according to claim 3, wherein an operating plate of said cassette means contacts said roller means of said paper separation and guide means and moves downwardly against the spring force of said spring means.

* * * * *